US006257784B1

(12) United States Patent
Mantell

(10) Patent No.: US 6,257,784 B1
(45) Date of Patent: Jul. 10, 2001

(54) METHOD FOR EXPEDITING THE HANDLING OF PRINTER BIN OUTPUT

(75) Inventor: David A. Mantell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/738,752

(22) Filed: Dec. 15, 2000

(51) Int. Cl.[7] ..... B41J 13/00; B41J 11/44

(52) U.S. Cl. ..... 400/578; 400/582; 101/416.1; 101/419; 347/102; 347/105

(58) Field of Search ..... 347/102, 104, 347/105; 400/578, 582; 101/419, 416.1

(56) References Cited

U.S. PATENT DOCUMENTS 4,728,963 3/1988 Rasmussen et al. ..... 346/25
5,396,270 * 3/1995 Gooray et al. ..... 346/25
5,489,926 * 2/1996 Arbeiter ..... 347/16
5,921,690 * 7/1999 Shinmachi et al. ..... 400/625
6,149,327 * 11/2000 Ward et al. ..... 400/582

FOREIGN PATENT DOCUMENTS

02000141622A * 5/2000 (JP) .
02000185436A * 7/2000 (JP) .

* cited by examiner

*Primary Examiner*—John S. Hilten
*Assistant Examiner*—Charles H. Nolan, Jr.
(74) *Attorney, Agent, or Firm*—Christopher D. Wait

(57) ABSTRACT

A method for improving human interaction with a printer and its hardcopy output. The method comprises printing a first page and placing it into an output bin followed with a pause to allow for full drying of the print. However, this pause will be interrupted if the page is removed from the output bin and thereby expedite any subsequent printing output that may be queued follow.

21 Claims, 3 Drawing Sheets

METHOD FOR EXPEDITING THE HANDLING OF PRINTER BIN OUTPUT

BACKGROUND OF THE INVENTION AND MATERIAL DISCLOSURE STATEMENT

The present invention relates to a methodology for expediting the handling of print job output in the output bin of a printer. In particular, the present invention relates to where ink drying time is a concern that must be considered, as found for example with ink jet printers.

Ink jet printers have become very popular particularly for providing color print output. This has much to do with the economy of their production and therefore end cost to the consumer. Much of this economy has to do with inks that are used allow a relatively inexpensive hardware configuration. However, the inks used typically have a finite drying time which is slower than other types of printers. Much effort has been expended in overcoming the problems that arise from this limitation including developing faster dry inks. One such early approach was to simply take advantage of a slower print rate which would allow sufficient drying time between pages of printout. Where faster output is demanded this is a limitation to throughput. One approach as practiced by Hewlett Packard in U.S. Pat. No. 4,728,963 to Rasmussen et al., and incorporated in its entirety for its teaching, involves using collapsible support rails which hold the most recent page of printout above the output stack. It then drops that most recent page prior to another page of printout arriving for the output bin. This effectively increases the drying time and helps avoid one page sticking to another. This also helps with offset problems, where ink from the front of one page is transferred to the back of another page.

Another approach which is taken to solve ink drying time problems is to put a pause in the printing of a subsequent page until there is sufficient time for the drying of the current page. This time varies depending upon the page material. For example, transparencies need a considerably longer drying time so it is common for long pauses to be utilized in their printing. This considerably slows output and can be particularly frustrating when last minute transparencies are needed for a meeting or presentation.

Therefore, as discussed above there exists a need for a methodology which will solve the problem of page delays due to drying concerns before which subsequent pages may print. Thus, it would be desirable to solve this and other deficiencies and disadvantages with an improved methodology.

SUMMARY OF THE INVENTION

The present invention relates to a method for a printer of the liquid ink type requiring a finite drying time for the ink to provide printout to its output bin. The method comprises outputting a current page to the output bin and pausing the output of a subsequent page for a fixed period of time. The printer shall output the subsequent page if the current page is removed from the output bin before the fixed period of time has passed.

Further, the present invention relates to a method for a ink jet printer to provide printout to its output bin, comprising outputting a current page to the output bin and pausing the output of a subsequent page until at least one of the following two conditions has been met. A fixed period of time has elapsed or, the current page has been removed from the output bin.

More particularly, the present invention relates to a method for an ink jet printer to provide printout to its output bin, comprising outputting a current page to the output bin and setting a pause counter. This is followed by stepping the pause counter and then determining if the current page has been removed from the output bin. The last step is outputting the subsequent page if the current page has been removed from the output bin or, if not, stepping the pause counter if the current page has not been removed from the output bin. The determination and this last step are repeated until the counter times out or the page is removed, which ever comes first.

DESCRIPTION OF THE INVENTION

Figure 1:
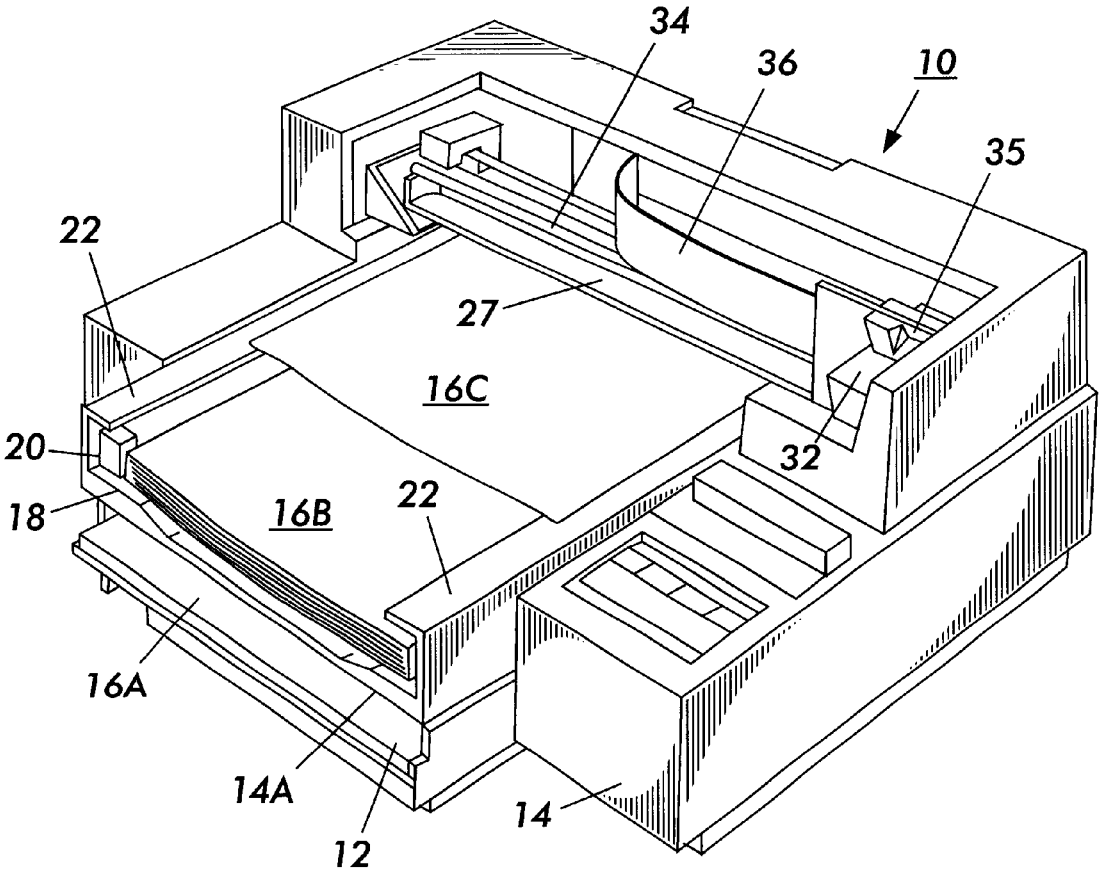
FIG. 1 depicts a typical printer with a output bin sensor.

FIG. 1 provides an ink jet printer 10. There, it will be observed that a paper input or supply tray 12 is provided in the front, or user-facing portion, 14 of the printer 10. The paper input tray 12 is configured to handle a substantial quantity of paper 16*a* or other medium for printing thereon. Also in the front 14 of the printer 10 is provided a paper output or collection tray 18. The paper output tray 18 is also configured to handle a substantial quantity of paper 16*b*.

There are two features to be noticed with regard to the paper output tray 18. First, an output bin sensor 20 is provided near the rear of the paper output tray 18. Sensor 20 is provided for indication of whether the user has removed the previous page or output paper 16*b*. The operation of sensor 20 may be based for example upon sensing weight, light scattering or light reflectance effects from when paper 16*b* is present or not in collection tray bin 18. In a preferred embodiment, an inexpensive simple LED detector pair is used that can detect either a reflectance or a scattering signal. Thus both transparencies and paper can be detected. Many other arrangements will be conceivable to those skilled in the art and as such are considered within the gambit of the present invention. It should be noted for instance that there are many arrangements for providing this sensor functionality including its placement location in the output bin. For example, many printer systems already have a sensor provided at the output for the purpose of tracking paper jams. Such arrangements may be utilized with the present invention with little or even no modification as would be evident to one skilled in the art.

Second, a pair of opposed output rails 22 is provided above the output tray 18. These output rails 22 along with the platen (not visible in this view) support a sheet of paper 16*c* during the printing operation to permit the ink on the sheet 16*b* underneath to dry. At the end of the printing cycle, when the sheet 16*c* is near the front 14*a* of the paper output tray 18, the platen pivots down, eliminating the clamping of the sheet between the platen and paper guide 27. The sheet 16*c* then drops into the paper output tray of its own weight. Up until the completion of the printing cycle, the rear end of the paper is supported by the paper drive roller and the platen.

The front portion 14 of the printer 10 is also provided with a control panel 28, which is electrically associated with a microprocessor/controller 200 (FIG. 2) for selection of various options relating to the printing operation. Such control operations, provided by presently-available microprocessors, are well-known in the prior art.

Also shown in FIG. 1 is a printhead carriage 35, which travels on a guide rail 34 and paper guide 27, and printhead 32 which is connected by a flexible electrical flat ribbon 36 to the microprocessor/controller 200. The microprocessor/controller 200 controls a motor, which provides movement of the printhead carriage 35. The printhead 32 is specifically designed for this ink-jet printer, and utilizes thermal ink-jet printing technology. However, the printer could operate with other ink-jet printheads if the printhead carriage interfaces are compatible, or with other carriage configurations. Further, reconfiguration of the printhead carriage 32 would permit the use of other ink-jet technologies, such as piezoelectric. Such reconfiguration is within the capabilities of one skilled in the art.

Figure 2:
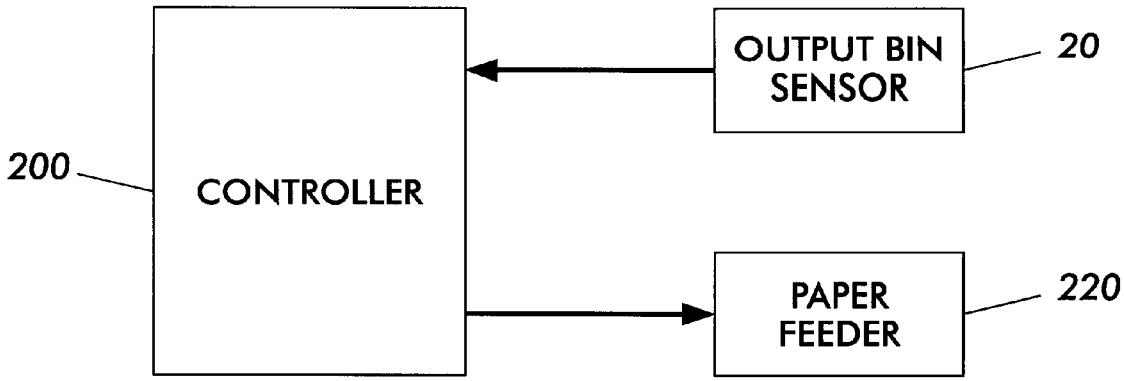
FIG. 2 shows schematic block diagram of on possible hardware configuration for the present invention.

FIG. 2 provides a concise schematical representation of a preferred embodiment. Controller 200 is coupled with output bin sensor 20. In a preferred embodiment controller 200 polls for an indicator from sensor 20. When sensor 20 indicates that the printout has been removed from the output bin the controller 200 executes a decision to end a counter/timer loop and proceed directly to the printing of the new page of hardcopy if any. As such the controller 200 may now direct the paper feeder 220 or platen to advance the present page and allow it to drop from rails 22.

In an alternative embodiment, the signal indication of printout removal from output bin by sensor 20 is handled by the controller 200 as an interrupt. Those skilled in the art will understand what software changes are necessary for that scenario. Indeed, there are many other hardware and software specifics which will yield the same result, including for example custom logic circuits dedicated to implementing the logic flow discussed below.

Figure 3:
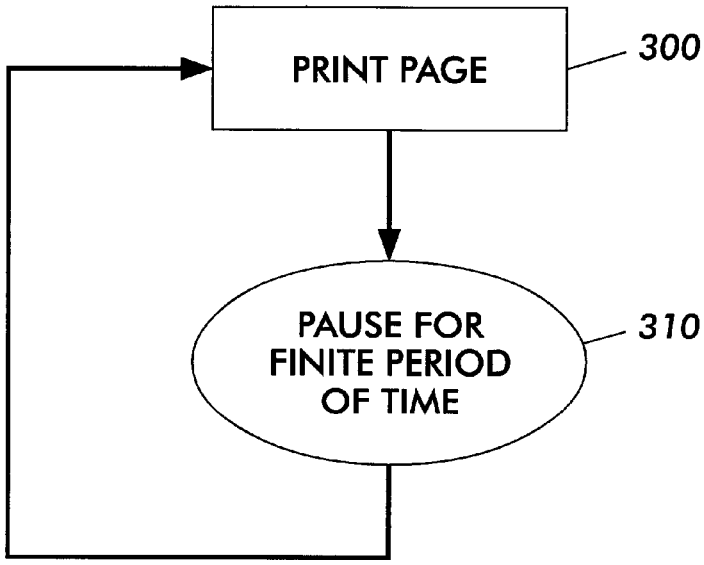
FIG. 3 depicts a simplified flow chart of a prior art approach to achieving acceptable drying times.

FIG. 3 depicts one probable flow chart of the prior art approach taken in a typical ink jet printer. Block 300 represents the print page command. Typically when a print page command is made a determination of the printout type is made and there by the amount of pause time required. For example, when a transparency is to be generated, a greater pause time is required to allow for the ink drying on that media type. Paper may need little or no additional time for drying. This determination of the amount of pause then sets the delay in block 310. This is typically a count-up or a count-down counter although other approaches may be taken such as executing different loops of no-ops (no operation micro-code instructions) as will be evident to those skilled in the art.

Figure 4:
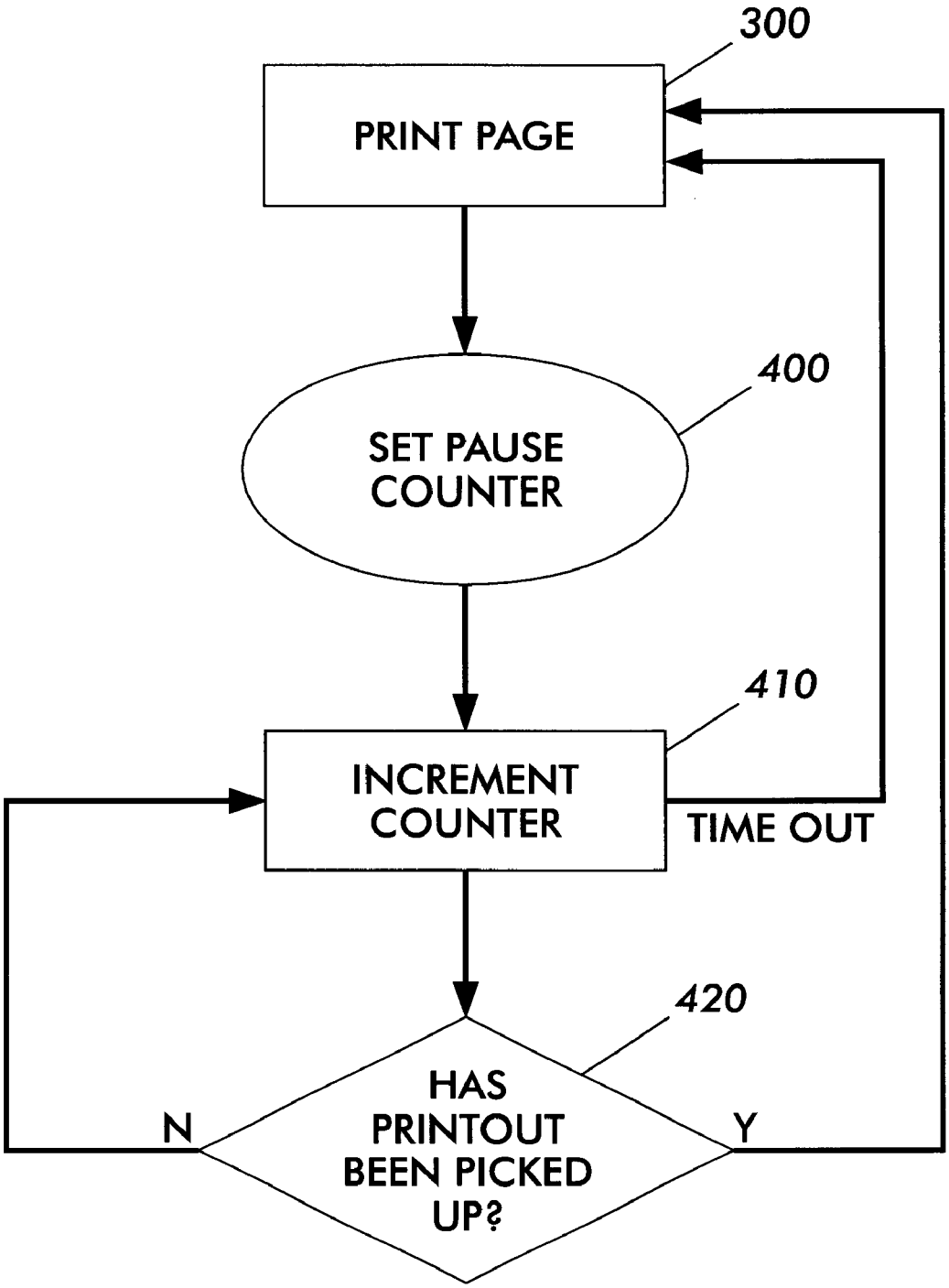
FIG. 4 depicts a flow chart for the present invention which makes allowance for an output bin sensor.

A preferred embodiment of the invention, as shown in FIG. 4, also starts with the same print page command 300 block. However, a determination of counter setting is made at block 400. The counter in this embodiment is an incrementing type which counts up to a specified number before triggering for a new page. Block 410 increments the counter for each loop iteration. After action block 410 executes, the next logic step is decision block 420. Here the sensor 20 signal is checked to see if there is indication that the hardcopy printout **16*b* has been removed from the output tray 18. If it has then the increment counter 410 is bypassed and the next page is printed. If not then the counter is incremented and the decision block 420 addressed again until either the counter reaches the specified number and times out, or the printout 16*b* is removed, which ever happens first. The purpose here is that either a time out or pickup of printout will invoke a new print page 300**. Those skilled in the art will recognize there are any number of other approaches to achieve this same logic flow result.

In summary, practicing the methodology of the present invention reduces the amount of time required to generate hardcopy output when human attendance is available to intervene in the ink drying cycle. By providing a sensor at the output bin or making use of one already there, intelligence may be provided with a small amount of additional code in the controller. This allows a less frustrating experience for an end user who, if anxious for printout, is willing to remove the current printout and allow it to dry elsewhere. Furthermore, While the embodiment disclosed herein is preferred, it will be appreciated from this teaching that various alternative, modifications, variations or improvements therein may be made by those skilled in the art, which are intended to be encompassed by the following claims.

What is claimed is:

1. A method for a printer to provide printout to its output bin, the printer being of the liquid ink type and requiring a finite drying time for the ink, comprising:

outputting a current page to the output bin;

pausing the output of a subsequent page for a fixed period of time; and, outputting the subsequent page if the current page is removed from the output bin by a user before the fixed period of time has passed.

2. The method of claim 1 wherein the printer is an ink jet type.

3. The method of claim 2 wherein the step of pausing is accomplished using a counter.

4. The method of claim 3 wherein the counter is an incrementing type.

5. The method of claim 3 wherein the counter is an decrementing type.

6. The method of claim 3 wherein the counter is achieved with nested loops of no-op micro-code commands.

7. The method of claim 2 wherein determination of the current page being removed from the output bin is accomplished with a sensor in the output bin.

8. A method for a ink jet printer to provide printout to its output bin, comprising:

outputting a current page to the output bin;

setting a pause counter;

stepping the pause counter;

determining if the current page has been removed from the output bin; and, outputting the subsequent page if the current page has been removed from the output bin by a user; or, stepping the pause counter if the current page has not been removed from the output bin by a user.

9. The method of claim 8 wherein the counter is an incrementing type.

10. The method of claim 8 wherein the counter is an decrementing type.

11. The method of claim 8 wherein the counter is achieved with nested loops of no-op micro-code commands.

12. The method of claim 8 wherein the determination of the current page being removed from the output bin is accomplished with a sensor in the output bin.

13. The method of claim 12 wherein the determination of the current page being removed from the output bin is accomplished by polling the sensor.

14. The method of claim 12 wherein the determination of the current page being removed from the output bin is accomplished by receiving an interrupt from the sensor.

15. The method of claim 8 wherein the step of setting the counter the period of time the counter is set to depends on the media type.

16. The method of claim 8 wherein the step of setting the counter the period of time the counter is set to depends on the ink coverage on the page.

17. The method of claim 8 wherein the step of setting the counter the period of time the counter is set to depends on the maximum ink coverage in one of multiple regions on the page.

18. The method of claim 8 wherein the step of setting the counter the period of time the counter is set to depends on the black ink coverage on the page.

19. The method of claim 8 wherein the step of setting the counter the period of time the counter is set to depends on environmental conditions.

20. The method of claim 19 wherein the environmental condition is temperature.

21. The method of claim 19 wherein the environmental condition is humidity.

* * * * *